United States Patent [19]

Neumann et al.

[11] 4,099,656

[45] Jul. 11, 1978

[54] MULTI-PURPOSE CARRYING BAG OR CASE

[75] Inventors: Henning Neumann, Munich; Horst Schalausky, Pocking; Horst Britschinn, Munich, all of Fed. Rep. of Germany

[73] Assignee: Metzeler Kautschuk AG, Munich, Fed. Rep. of Germany

[21] Appl. No.: 774,632

[22] Filed: Mar. 4, 1977

[30] Foreign Application Priority Data

Mar. 11, 1976 [DE] Fed. Rep. of Germany ... 7607449[U]

[51] Int. Cl.[2] ..... A45F 5/00

[52] U.S. Cl. ..... 224/5 W; 224/8 R; 224/47; 150/1

[58] Field of Search ..... 224/47, 5 W, 8 R, 9, 224/31, 25 A, 43; 150/1, 0.5; 24/205.11 L

[56] References Cited

U.S. PATENT DOCUMENTS

| | | | |
|---|---|---|---|
| 294,622 | 3/1884 | Honinger | 224/9 X |
| 849,667 | 4/1907 | Evans | 224/12 X |
| 2,518,651 | 8/1950 | Weiss et al. | 150/1 X |
| 2,558,807 | 7/1951 | Bailey | 150/0.5 X |
| 3,271,832 | 9/1966 | Yankers | 24/205.11 L |
| 3,679,108 | 7/1972 | Ingram | 224/8 R |
| 3,965,953 | 9/1974 | Becker et al. | 150/0.5 X |
| 3,978,901 | 9/1976 | Jones | 150/0.5 |

FOREIGN PATENT DOCUMENTS

| | | | |
|---|---|---|---|
| 741,230 | 11/1955 | United Kingdom | 150/0.5 |

*Primary Examiner*—Drayton E. Hoffman
*Assistant Examiner*—Donald W. Underwood
*Attorney, Agent, or Firm*—Armstrong, Nikaido, Marmelstein & Kubovcik

[57] ABSTRACT

A multi-purpose carrying bag or case having a parallelepiped shape is provided. The carrying bag or case comprises a shell of a watertight and airtight, rip-resistant material, the shell having top and bottom portions, first and second longitudinal side portions and first and second end portions; a slot-type opening provided in said upper portion and being closeable by means of a watertight and airtight zipper; and a fill-valve provided in said shell for filling the interior of the carrying bag or case.

7 Claims, 6 Drawing Figures

MULTI-PURPOSE CARRYING BAG OR CASE

BACKGROUND OF THE INVENTION

The present invention relates to a multi-purpose carrying bag or case, preferably having a parallelepipedal shape and comprising an upper slot-form opening which is closeable by means of a zipper.

Conventional carrying or sports bags are made of textile fabrics or synthetic materials and are adapated to be carried by means of a rigidly attached carrying strap, e.g., a strap having ends that are attached to the bag by sewing or the like. In the case of one conventional form of bag, the user grips the carrying straps formed into carrying loops, from above, whereas in the case of other types of bags, for example, back packs or sports bags, the straps are placed over both shoulders or, in an inclined manner, over one shoulder.

The disadvantage of these bags is that they can only be used for the specific task for which they are intended because of their carrying straps being rigidly attached to the bag body. Moreover, on account of the materials used and the seam configuration, they are not watertight.

A recurrent problem involved with expeditions, hikes water sports or camping is that of finding a way to pack items of equipment in a sealed manner. A further desirable expedient is to find a carrying bag that can be adapted for different uses. It should be possible for the bag to be used as a normal bag, for example, as a backpack which is suspended over both shoulders, or as a sports bag which is suspended over one shoulder. It should also be possible for the bag to be lashed to the roof of a car or to the deck of a boat and to be used for carrying drinking water or as a portable shower.

SUMMARY OF THE INVENTION

The above task can be solved by means of a carrying bag of the type to be described which is characterized in that it is made of a waterproof and airtight, tear-resistant material, in that the opening thereof is closeable by an airtight and watertight zipper and in that it comprises a fill-up valve for filling the interior of the bag. In addition, the bag preferably comprises six fittings on its bottom face for the arbitrary insertion of a longitudinally adjustable loose, carrying strap; four of the fittings being disposed at the corners of an imaginary rectangele and the other two fittings being disposed in the longitudinal median plane of the bag and without the rectangle. A bag which is equipped in this manner can be readily adapted for a variety of different applications. The interior of the bag is sealed in an airtight and watertight manner and it can even be subjected to overpressure. As a result, the bag adopts a readily transportable and stowable shape. The fill-up valve is suitable for both air and water and thus the bag can be used as a water container. When filled with air the bag is unsinkable and is especially suitable for water sports. Additional applications for which it can be used consist of, for example, a stowage cushion, compressed air cushion or water container for camping and hiking.

In the case of another embodiment of the invention, the bottom of the bag has a double configuration and forms an additional watertight and airtight chamber. This chamber can be pressurized by means of an additional valve disposed inside the bag. As soon as pressure is exerted on this additional chamber the bag stiffens, rendering it particularly comfortable to carry when it is being used as a backpack, since the additional chamber protects the user's back. In the inflated state the additional chamber also renders the equipment-filled bag unsinkable In the case of another embodiment of the invention the fill-up valve is disposed on one of the end sides of the bag and is a perforated bottom valve having a removable valve insert. This feature enables the bag to be rapidly filled with air or water. The perforated bottom enables the bag, when filled with water and suspended, to be used as a portable shower. This is an especially important advantage for expeditions or hikes to remote areas.

The carrying straps which are adapted to be arbitrarily inserted in the fittings provided on the bag not only enable the bag to be carried in many different ways but they can also be used to lash it to vehicles or boats, thereby preventing the bag from being jolted free by sudden movements. This is especially advantageous on canoe trips as the body of the canoe is permanently immersed in water and the canoeist is unable to store large pieces of equipment inside the canoe.

Other features of the invention will be described in conjunction with the description of the drawings and the preferred embodiments.

BRIEF DESCRIPTION OF THE DRAWINGS

The invention is described below with reference to the accompanying drawings, in which.

DESCRIPTION OF PREFERRED EMBODIMENTS

Figure 1:
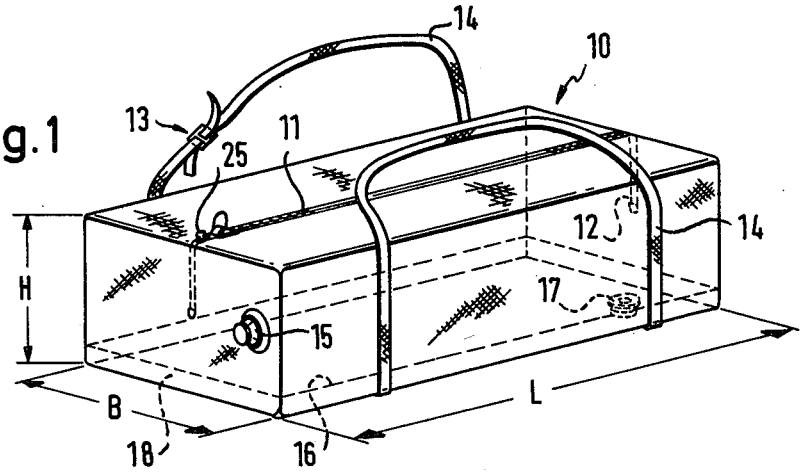
FIG. 1 is a perspective view of the carrying bag.

Referring now to FIG. 1. The carrying bag 10 has a parallelepipedal or trunk shape. The interior of the bag is accessible via an airtight and watertight zipper 11 extending in the direction of the longitudinal median plane of the carrying bag. In one embodiment of the invention the zipper 11 is extended to the point 12 on the end side of the bag. The end of the zipper 11 can be secured by means of a press fastener or hook 25. The bag 10 can be carried by means of an endless strap 14 which is longitudinally adjustable by means of a buckle 13. In the position shown in FIG. 1, the strap 14 forms two carrying loops.

A fill-up valve 15 of the type used on rubber rafts is shown as being provided on one of the end sides of the bag. The valve 15 can be used to fill the interior of the bag with compressed air or water. The bottom of the bag 10 can be provided with a further fabric layer 16, as represented by the perforated line. This provides an airtight and watertight chamber 18 inside the bag that can be filled via an additional valve 17.

The relative height, width and length dimensions of the bag 10 are generally in the ratio of about 1:1.5:3. Accordingly, a bag having a height of 25 cm may have a width of about 35 cm and will be approximately 75 cm in length. This is a very handy size and even large pieces of equipment can be placed therein. A suitable material for the bag is a resilient airtight and watertight rubberized or coated woven material, for example, a rubber or polyurethane coated nylon fabric. Other common, tear-resistant, airtight and watertight materials, however, can also be used. These may be, for example, polyethylene, polyester, polyurethane, polyvinylchloride, polypropylene, polyamide and other synthetic webs. If necessary, these webs can be reinforced with reinforcing layers in the form of glass or textile fibers, paper, metal threads or gauzes. Rubber raft manufacturers can use boat fabric remnants or waste materials for the bags. The carrying straps may be made of the same material with the material being doubled to increase the strength and durabilty thereof. Valves used in boat construction can be used as the fill-up valves. Fittings used in boat construction can also be used and thus the bags can be produced at low cost as a by-product of the boat manufacturing industry.

The above-described carrying bag is especially suited for the following applications: in water sports for the watertight and buoyant storage of all types of articles, as buoyancy elements, floats, set cushions or foot supports, for canoes or for holding diving gear. It can also be used as a backpack for hiking or as a sports bag, as a water bag, provisions container or as a portable shower for expeditions.

Figure 2:
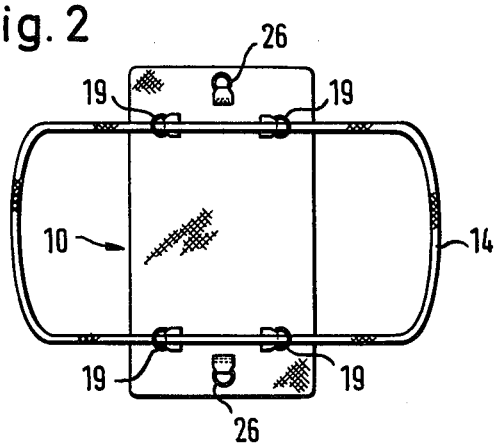
FIG. 2 shows the bottom of the carrying bag from below.

FIG. 2 shows the bottom of the carrying bag 10 from below. Simple fittings 19 and 26 are provided for insertion of the carrying strap 14. Four fittings 19 are provided at the corners of an imaginary rectangle and two fittings 26 are provided without this rectangle in the longitudinal median plane of the same. The fittings 19 and 26 may be, for example, annular, or eye, rings affixed to the bottom of the bag by means of an adhesive or vulcanization.

Figure 4:
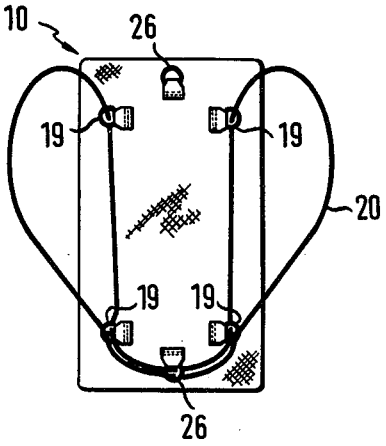
FIG. 4 shows the carrying strap used as a backpack strap.
Figure 5:
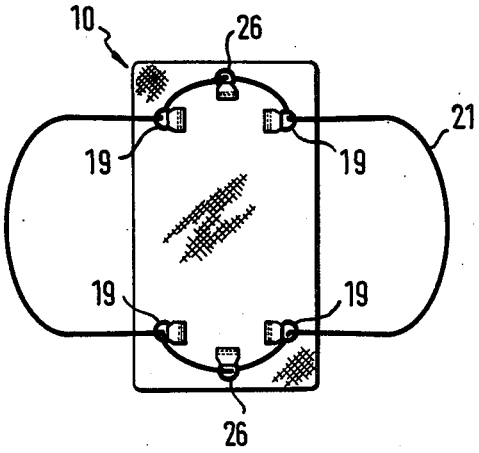
FIG. 5 shows the strap inserted through all the loops so that the bag can be used for carrying heavy loads.
Figure 6:
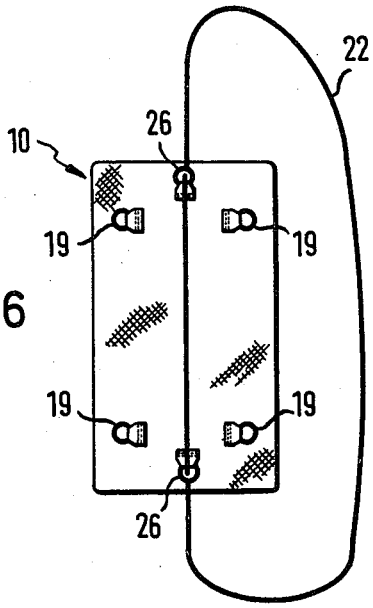
FIG. 6 shows the supporting strap used as a carrying strap for a sports bag where it is only inserted through two loops.

The fittings 19 enable the strap 14 to be positioned in different ways according to the proposed application and manner of carrying the bag. If the bag is carried as shown in FIG. 1, the strap is only inserted in the four annular fittings. As shown in FIG. 4 by the solid lines 20, the strap 14 can also be inserted in the manner of a backpack carrying strap. When the bag is fully loaded and heavy it is advisable to use all the fittings to distribute the forces of inertia in the manner represented by the solid line 21 in FIG. 5. If, however, the bag is to be used as a sports bag the strap need only be inserted through fittings 26, as represented by the line 22 in FIG. 6. The user can then suspend it from one shoulder. To lash the bag to a vehicle, it is advisable to open the buckle 13 of the strap 14 and then tie down the bag 10 in the desired manner.

Figure 3:
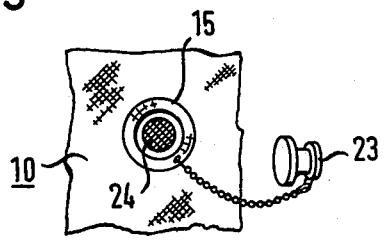
FIG. 3 is a detailed view of one embodiment of the fill-up valve of the carrying bag.

FIG. 3 shows a plan view of the fill-up valve 15 on the end side of the bag 10. The valve insert 23 is shown in the extracted position so as to demonstrate the perforated bottom 24 of the valve with its openings. This is intended to show how the bag can be used as a portable shower when filled with water.

Although the invention has been described in conjunction with certain preferred embodiments it is not intended to be limited thereto but, instead, is intended to include all embodiments within the scope and spirit of the appended claims.

What is claimed is:

1. A multi-purpose carrying bag or case having a parallelpiped shape and comprising: a shell of a watertight and airtight, rip-resistant material, said shell defining an interior and having top and bottom portions, first and second longitudinal side portions and first and second end portions, said bottom portion comprising two coextensive layers of said watertight and airtight, rip-resistant material which form a watertight and airtight bottom compartment in said carrying bag or case and a first fill-valve which communicates with the interior of said compartment and is accessible from the interior of said bag; a slot-type opening provided in said upper portion and being closeable by means of a watertight and airtight zipper; a second fill-valve provided in said shell for filling the interior of the carrying bag or case; and a longitudinally adjustable carrying strap movably connected to said shell and six fittings adapted for the arbitrary insertion of the carrying strap, said fittings being affixed to said bottom portion of said shell, four of the fittings being disposed at the corners of an imaginary rectangle on said bottom portion and two additional fittings being disposed in the longitudinal median plane of the bag and without said imaginary rectangle.

2. The multi-purpose carrying bag or case as claimed in claim 1, wherein the watertight and airtight, rip-resistant material is a rubber or plastic coated textile fabric or a polyethylene, polyamide, polyvinylchloride, polyurethane, polyester, polypropylene or polystyrene web provided with a reinforcing layer.

3. The multi-purpose carrying bag or case as claimed in claim 1, wherein the fittings consist of eye rings which are affixed to said bottom portion by means of adhesive or vulcanized in place and wherein the carrying strap is made of a double layer of the material of the shell.

4. The multi-purpose carrying bag or case as claimed in claim 3, wherein said zipper in said upper portion extends in a longitudinal direction and is secured by means of a press fastener or hook.

5. The multi-purpose carrying bag or case as claimed in claim 4, wherein said zipper extends into at least one of said side portions.

6. The multi-purpose carrying bag or case as claimed in claim 1 wherein said second fill-valve is disposed in one of the end portions of said shell and has a perforated bottom having a relatively large cross-section and a removable valve insert.

7. The multi-purpose carrying bag or case as claimed in claim 1, wherein the relative height, width and length dimensions thereof are in the ratio of 1:1.5:3.

* * * * *